US006460962B1

(12) United States Patent
Dietl et al.

(10) Patent No.: US 6,460,962 B1
(45) **Date of Patent: *Oct. 8, 2002**

(54) INK JET PRINTER WITH SENSING SYSTEM FOR IDENTIFYING VARIOUS TYPES OF PRINTHEAD CARTRIDGES

(75) Inventors: Steven J. Dietl, Ontario; Dennis M. Lengyel, Hemlock; Donald M. Stevens, Walworth; Vincent J. Ouellette, Fairport; Vladimir M. Kupchik, Pittsford, all of NY (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1010 days.

(21) Appl. No.: 08/669,120

(22) Filed: Jun. 24, 1996

(51) Int. Cl.[7] ..... B41J 29/00; B41J 2/01
(52) U.S. Cl. ..... 347/19; 347/86
(58) Field of Search ..... 347/19, 86; 250/221, 250/222.1, 229

(56) References Cited

U.S. PATENT DOCUMENTS

| | | | |
|---|---|---|---|
| 4,833,491 A | 5/1989 | Rezanka | 346/140 R |
| 4,872,027 A | 10/1989 | Buskirk et al. | 346/140 R |
| 5,049,898 A | 9/1991 | Arthur et al. | 346/1.1 |

OTHER PUBLICATIONS

Kenneth W. Altfather et al., Ser. No. 08/572,595, filed Dec. 14, 1995, D/95395, "Sensing System for Detecting Presence of an Ink Container and Level of Ink Therein".

*Primary Examiner*—Daniel J. Colilla
(74) *Attorney, Agent, or Firm*—Joseph R. Sakmyster; David J. Arthur

(57) ABSTRACT

A printhead cartridge identification system is disclosed which ensures that an ink jet printer operates only with ink jet cartridges compatible with the specific printer function. An ink container which supplies ink to an associated printhead has a light reflector incorporated into a transparent wall of the ink container housing. The cartridge, comprising the ink container and associated printhead, is mounted on a scan carriage. Periodically, the carriage is conveyed to an optical station comprising a light source and a photosensor. The light source is energized and a beam of light is directed towards the reflector.

17 Claims, 9 Drawing Sheets

INK JET PRINTER WITH SENSING SYSTEM FOR IDENTIFYING VARIOUS TYPES OF PRINTHEAD CARTRIDGES

BACKGROUND OF THE INVENTION AND MATERIAL DISCLOSURE STATEMENT

The present invention relates to ink jet recording devices and, more particularly, to a system for detecting and identifying the presence of a specific type of printhead cartridge.

Ink jet recording devices eject ink onto a print medium such as paper in controlled patterns of closely spaced dots. To form color images, multiple groupings of ink jets are used, with each group being supplied with ink of a different color from an associated ink container.

Thermal ink jet printing systems use thermal energy selectively produced by resistors located in capillary filled ink channels near channel terminating nozzles or orifices to vaporize momentarily the ink and form bubbles on demand. Each temporary bubble expels an ink droplet and propels it toward a recording medium. Most commercial printing systems utilize a carriage type printer which has a relatively small printhead containing the ink channels and nozzles. The printhead is usually sealingly attached to an ink supply container and the combined printhead and container, referred to as a printhead cartridge, is reciprocated to print one swath of information at a time on a stationarily held recording medium, such as paper. After the swath is printed, the paper is stepped a distance equal to the height of the printed swath, so that the next printed swath will be contiguous therewith. The procedure is repeated until the entire page is printed.

An important practical concern for application of commercial thermal ink jet printers is to insure that a particular printhead cartridge assembly that is to be used is compatible with the function desired; i.e., if the printer is set to print in a first (red) color, that a red, rather than say black, cartridge assembly is installed. Alternatively, it may be required that a particular cartridge even though having a "correct" ink color is also the proper cartridge configuration for the specific system. For example, many commercial ink jet printers have OEM brand configurations and/or follow on products with perhaps, increased resolution, which may require a change in cartridge configuration and function. It is therefore desirable to identify that the second updated cartridge is being used rather than the earlier cartridge.

It is known in the prior art to provide encoding information on a printhead relating to a printhead characteristic such as color or serial number. U.S. Pat. No. 5,049,898 discloses encoded information in the form of a magnetic media which can be read by a magnetic read/write head to provide outputs for further use or display. U.S. Pat. No. 4,872,027 discloses a resistor circuit formed on a printhead in encoded form. The encoded information is addressed from a microprocessor which reconfigures control functions to provide different processing capabilities such as text or graphics. Co-pending application USSN 08/650,149discloses a printhead identification system in which a unique digital code is formed on a printhead, or group of printheads. Print operation is enabled when a matching code signal from a system controller to the printhead is confirmed. Co-pending application Ser. No. 08/572,595 filed on Dec. 14, 1995 and assigned to the same assignee as the present invention, discloses a system and method for sensing the presence or absence of an ink jet cartridge combined with an ink level sensing function.

Those prior art references relying on printhead cartridge code formation and detection techniques can be relatively expensive. It would be desirable to have a detection system which provides an elegant, yet simple, method for identifying a small number of possible printhead cartridge types.

SUMMARY OF THE INVENTION

It is therefore one object of invention to provide a printhead cartridge identification system which is adapted to include a relatively simple identification element associated therewith together with a single inexpensive sensing means for "reading" the identification element and producing an output signal representative of the specific type of printhead cartridge sensed. The cartridge signal is then used to prepare an ink jet printer for operation with the specific type of printhead cartridge identified.

In the present invention, and in an exemplary embodiment, a thermal ink jet printer is disclosed which includes a printhead cartridge for printing on a recording medium in response to image drive signals. Ink is supplied to a printhead from an ink container which is fluidly connected to the printhead. The printhead and container are mounted on a scanning carriage which moves back and forth across a print zone, the printhead ejecting ink droplets from nozzles to form an image on the recording medium. An optical system comprising a light source and a light detector is fixedly located along the path of travel of the carriage and positioned so that light from the light source is directed towards the ink container when it is positioned opposite the optical system. The ink container has an optical light directing element formed in a wall recess. Light from the light source is directed towards the light detecting element. In one embodiment, a cartridge reflector has a reflective surface whose reflective intensity varies according to the composition of a selected reflective material. Optical means include a light source for directing light towards the reflector and a sensor for sensing the intensity of the reflected light. Each level of detected intensity corresponds to a specific type of printhead cartridge with a predetermined set of printing characteristics.

According to a second embodiment of the invention, the relative location of the light source and light sensor of the optical assembly with respect to the cartridge reflector is set so that the reflected light from the light source is sensed only when a specific type of cartridge is in place.

More particularly, and in a first embodiment, the present invention relates to an ink jet printhead cartridge sensing system for identifying a specific type of cartridge, the sensing system comprising:

- an optical assembly including a light source and a photosensor,
- means for positioning a cartridge adjacent said optical assembly, said cartridge including at least one reflective member,
- means for energizing said light source when said cartridge is adjacent said optical assembly, the light source emitting a beam of light which is directed generally towards said reflective member, said photosensor detecting the amount of light reflected from said reflective member and generating a signal indicative thereof and
- cartridge identification means for processing the photosensor output signal and determining whether the signal corresponds to a predetermined signal representative of a specific type of cartridge.

The invention, in a second embodiment, relates to an ink jet printhead cartridge sensing system for identifying a specific type of cartridge, the sensing system comprising:

an optical assembly including a light source and a photosensor separated from each other by a set distance, means for positioning said cartridge adjacent said optical assembly, said cartridge including at least one light reflective member comprising at least a first and second reflective member connected by a third surface, meaning for energizing said light source when said cartridge is adjacent said optical assembly, the light source emitting a beam of light which is directed generally towards said reflective member and reflected therefrom towards said photosensor, said photosensor generating a high output when the separation distance between the light source and the photosensor is approximately equal to the length of the third surface connecting the first and second reflective surfaces and a low output signal when the separation distance and the third surface length are not approximately equal, and cartridge identification means for processing the photosensor output signal and determining whether the signal corresponds to a predetermined signal representative of a specific type of cartridge.

DESCRIPTION OF THE INVENTION

Figure 1:
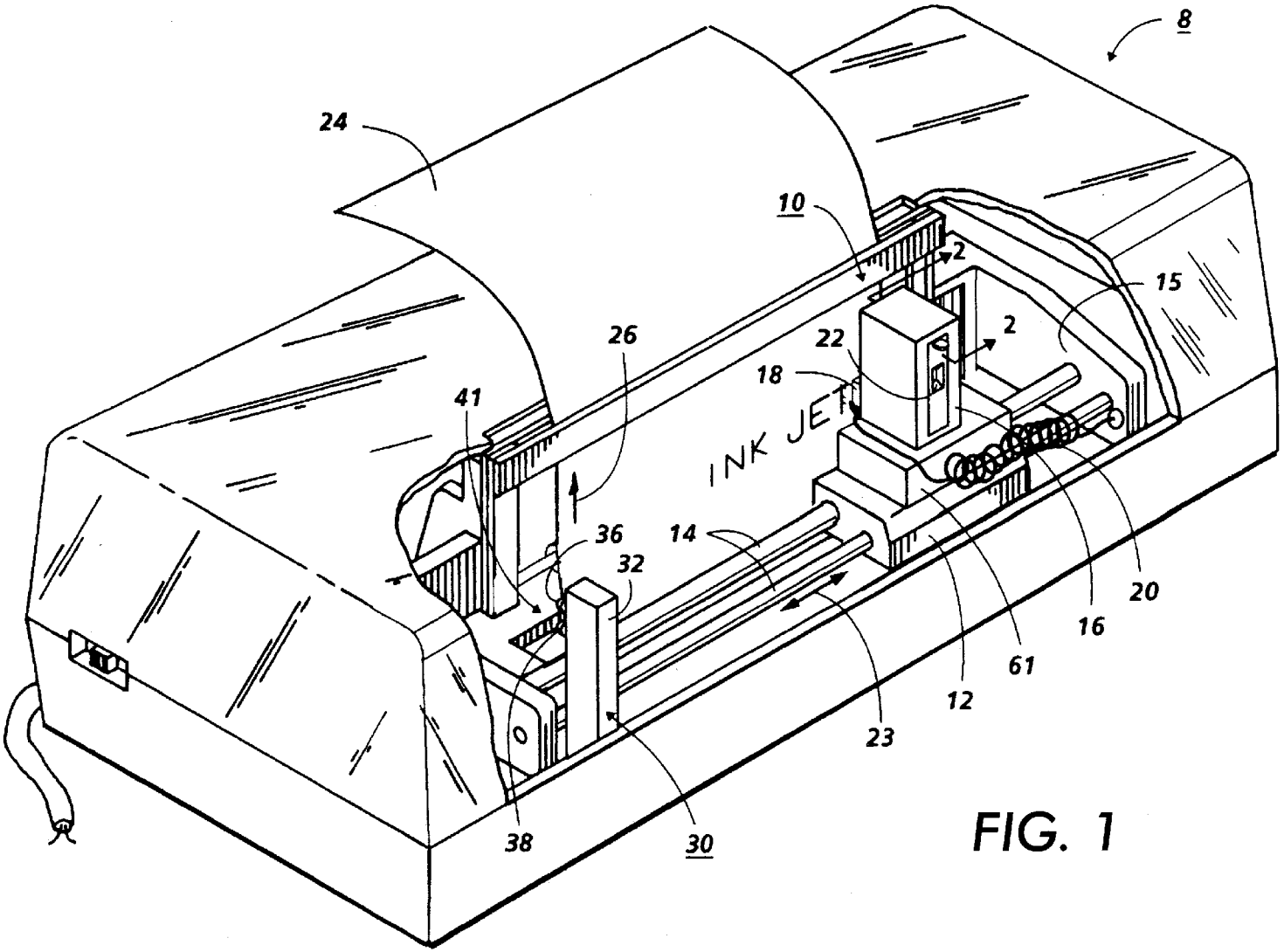
FIG. 1 illustrates a perspective view of an ink jet printer which incorporates the printhead cartridge identification system of the present invention.

FIG. 1 illustrates a perspective view of a thermal ink jet printer 8 of the type disclosed in co-pending application U.S. Ser. No. 08/572,595, referenced supra, whose contents are hereby incorporated by reference. A preferred embodiment of the printhead cartridge identification system of the present invention is disclosed for use with the illustrated printer, but it is understood the invention can be practiced in other types of thermal ink jet printers as well as other reproduction devices such as piezoelectric printers, dot matrix printers and ink jet printers driven by signals from a document Raster Input Scanner.

Referring to FIG. 1, printer 8 includes an ink jet printhead cartridge 10 mounted on a carriage 12 supported by carriage rails 14. The carriage rails are supported by a frame 15 of the ink jet printer 8. The printhead cartridge 10 includes a container 16 shown in detail in FIG. 2, containing ink for supply to a thermal ink jet printhead 18 which selectively expels droplets of ink under control of electrical signals received from a controller 50 (FIG. 3) of the printer 8 through an electrical cable 20. Container 16 comprises a housing 17 having a wall 17A seating reflective element 22, shown in further detail in FIG. 2. Container 16 is fluidly, but detachably connected, to printhead 18 and can be replaced when the ink is depleted therefrom. Alternatively, the entire cartridge can be replaced upon each depletion depending upon the particular system requirements. The printhead 18 contains a plurality of ink channels which carry ink from the container 16 to respective ink ejecting orifices or nozzles. When printing, the carriage 12 reciprocates back and forth along the carriage rails 14 in the direction of the arrow 23, the entire width traverse constitutes a scanning path. The actual printing zone is contained within the scanning path. As the printhead cartridge 10 reciprocates back and forth along a print path and past a recording medium 24, such as a sheet of paper or a transparency, droplets of ink are expelled from selected ones of the printhead nozzles towards the sheet of paper. Typically, during each pass of the carriage 12 the recording medium 24 is held stationary. At the end of each pass, the recording medium 24 is stepped in the direction of the arrow 26.

Figure 2:
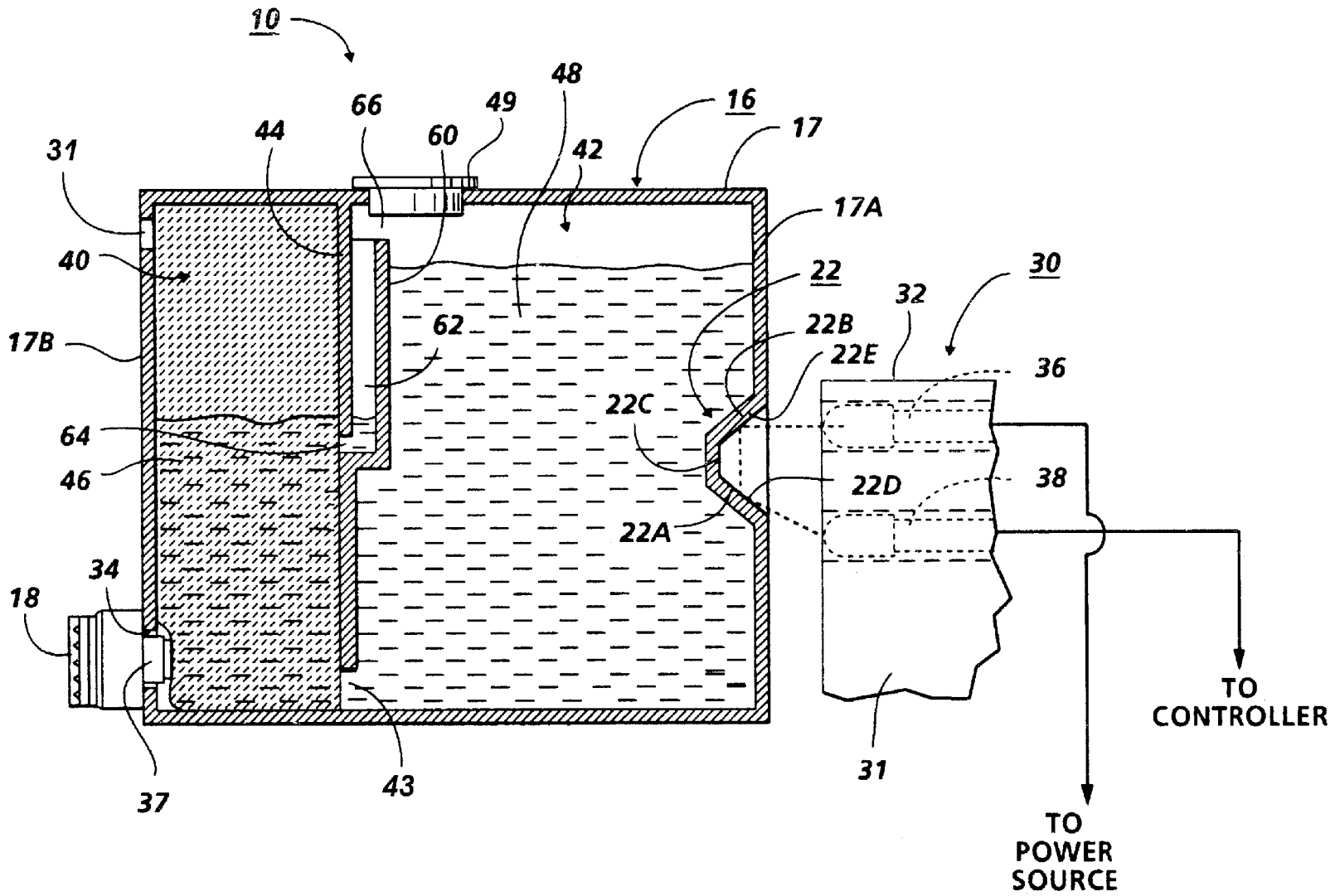
FIG. 2 is a cross-sectional view through the printhead cartridge shown in FIG. 1.

Also shown in FIG. 1 is an optical sensing assembly 30. Referring to FIGS. 1 and 2, assembly 30 includes a housing 31 within which are mounted a light source 36 and a photosensor 38. The light sources is electrically connected to a power source while the photosensor 38 output is electrically connected into the system controller circuits as will be seen. Container 16, in a preferred embodiment, is designed as a two compartment unit. Assembly 30 is mounted in the carriage path so that, as container housing wall 17A moves into a position opposite the assembly 30, the light from light source 36 is directed toward light directing element 22 Photosensor 38 is positioned to detect light directed from element 22 in the manner described in further detail below. Optical assembly 30 can also include a second light source which can be used to direct light towards a second reflective member in container 16 to sense the level of ink in the container. This configuration is disclosed and claimed in the co-pending application and is not described here but it is understood that an ink sensing system could be used in combination with the cartridge identification methods of the present invention.

FIG. 2 includes a cross-sectional view of the printhead cartridge 10 along the line 2-2 of FIG. 1 and shows the housing 17 and the printhead 18 attached to the container. The printhead 18 is fluidly but detachably connected to the container 16. The housing 17 is made of a lightweight but durable plastic, which in a preferred embodiment, is polypropylene. Housing 17 has an air inlet 31 and an ink outlet 34 formed within wall 17B. The air inlet 31 provides for the transfer of air between the interior of housing 17 and the ambient. Ink outlet 34 provides for fluid transfer of ink contained in the ink container 16 from the interior of the housing 17 to the ink jet printhead 18. Manifold 37 directs filtered ink from the ink outlet 34 into printhead 18 and to the ink ejecting orifices for ejecting ink onto the recording medium 24.

Housing 17 defines an interior space partitioned into a first chamber 40 and a second chamber 42 by a dividing member 44. The dividing member 44 extends from one side wall of the housing 17 to an opposite side wall of the housing and essentially divides the housing into the first chamber 40 and the second chamber 42 such that the second chamber 42 is larger than the first chamber 40.

The first chamber 40 contains an ink retaining member 46 typically made of a foam material to hold liquid ink. Liquid ink 48, stored in the second chamber 42, is transferred from the second chamber 42, which is substantially free of ink retaining material, to the ink retaining material 46 through an ink inlet 41 defined by the dividing member 44. A fill port 49 allows for filling the cartridge with ink. The ink 48 passes into the ink retaining material 46 through the ink inlet 41 and ink is released through ink outlet 34 as necessary to supply the printhead 18 with ink for printing. To maintain a proper amount of ink in the ink retaining material 46 for supply to the printhead 18, the housing 17 includes a mechanism for transferring ink from the second chamber 42 to the first chamber 40 by maintaining a proper amount of air pressure above the liquid ink 48 for filling the material 46 with ink when necessary. This mechanism includes a directing member 60, which defines, with the dividing member 44, an air transfer passageway 62 having a vent inlet 64 coupled to a vent outlet 66 for pressurizing the second chamber 42 to a static (no flow) condition. The directing member 60 does not extend from one sidewall to an opposite sidewall as does the dividing member 44, but instead forms a vent tube.

The construction of the container 16 compartments as described to this point is exemplary. There are other known ways of constructing an ink supply container with dividing sections while maintaining an appropriate back pressure to the printhead nozzle. For purposes of the present invention, it is understood that the container is constructed so that, during operation, ink moves from chamber 42 to chamber 40 through the passageway between the two compartments under pressure conditions established by techniques well known to those skilled in the art. Of interest to the present invention is the modification made to the ink container 16 by the specific construction of element 22 as described below.

Referring particularly to FIG. 2, in a preferred embodiment, light reflecting element 22 is formed as part of wall 17A. In the preferred embodiment, element 22 is a prism having two facet surfaces 22A, 22B extending into the interior of compartment 48 and angled towards each other and connected by surface 22C. Element 22 is formed into a roof mirror by placing reflective tapes 22D, 22E on surfaces 22A, 22B, respectively. According to a first aspect of the invention, tapes 22D, 22E can be formed of a plurality of reflective materials whose reflective intensity is representative of a predetermined type of printhead cartridge. For example, it is desired to identify a first type of printhead cartridge (Cartridge A) having a first specific print characteristic (color/ink density, resolution) and a second type of printhead cartridge (Cartridge B) having a second specific set of print characteristics. For Cartridge A, tapes 22D, 22E are made of polished aluminized hot stamp foil of a first reflective level. For cartridge B, tapes 22D, 22E are made of a polished aluminum hot stamp foil of a second lower reflective level.

Operation of Sensing System

Figure 3:
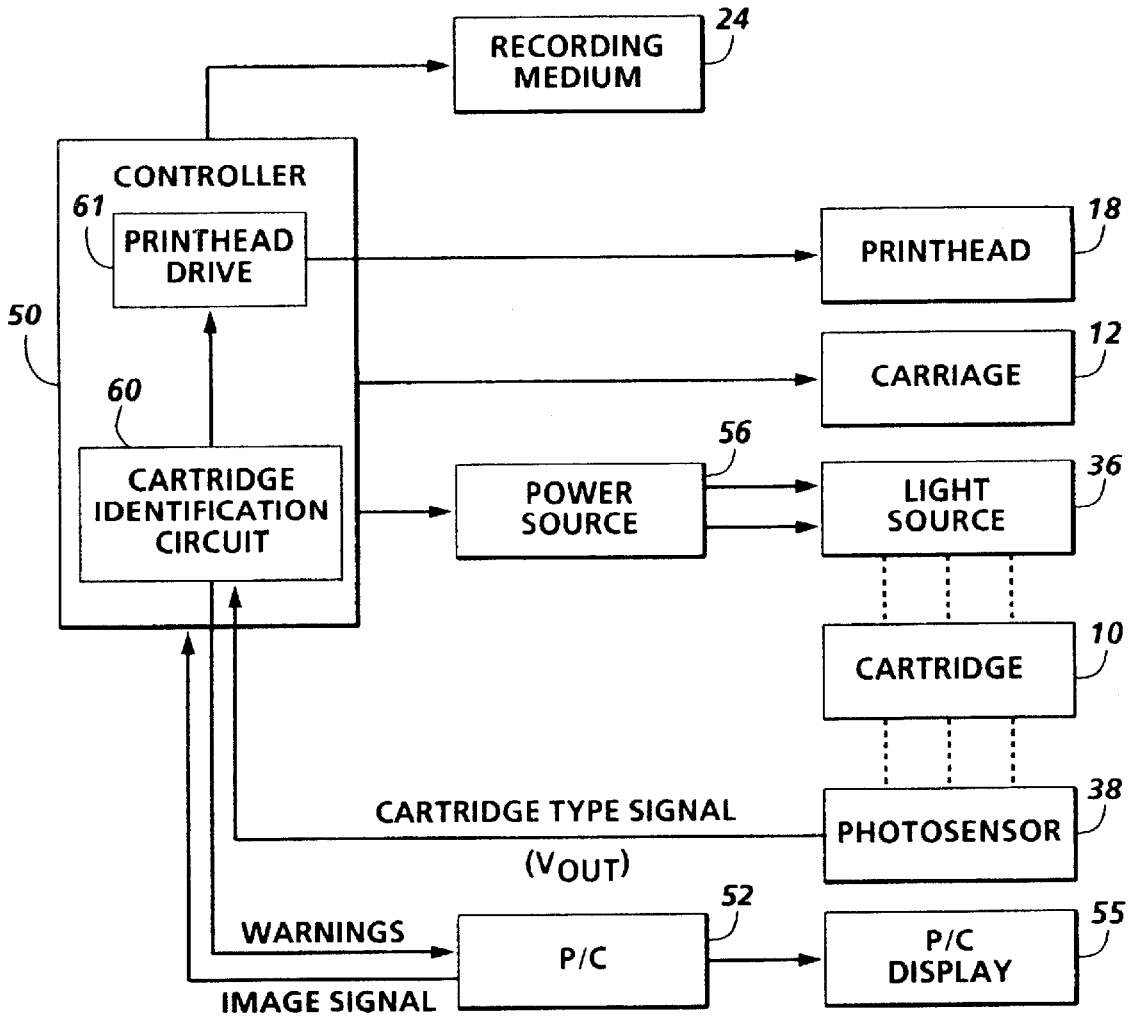
FIG. 3 is a block diagram of the control circuitry for controlling operation of the printhead cartridge identification system.
Figure 4:
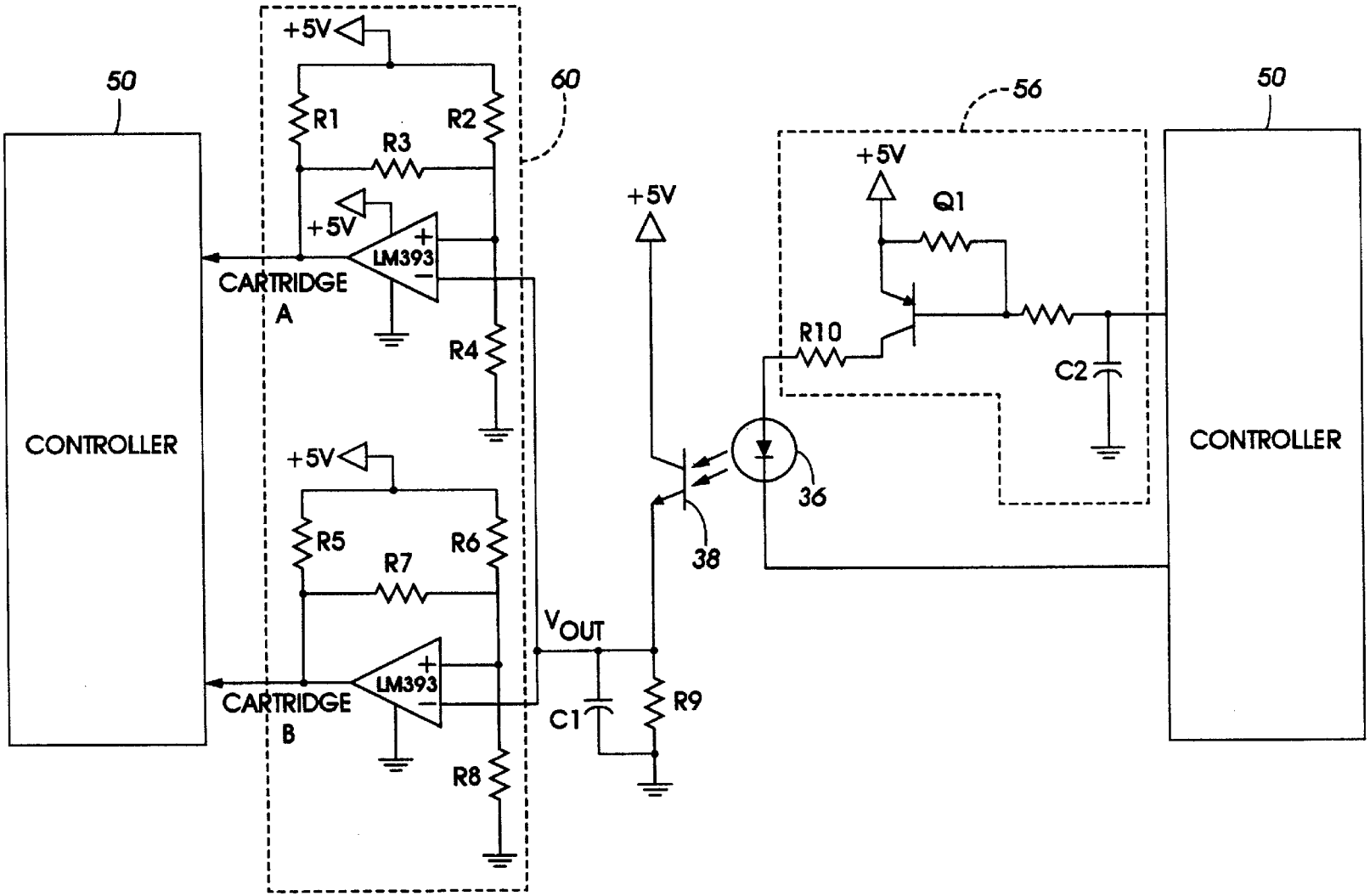
FIG. 4 is a schematic diagram of a comparator circuit used to correlate a sensed output signal to a specific cartridge.

The sensing system of the present invention, which is considered to comprise the combination of reflective element 22, the optical assembly 30, and the controller 50 circuitry, is designed to be enabled to perform a printhead cartridge identification following a specific event such as the start of a print job. To perform the check, the printhead cartridge is positioned adjacent assembly 30 where the identification is accomplished by appropriate circuitry. FIG. 3 shows control circuitry in block diagram form for enabling the sensing system. FIG. 4 shows a schematic of the comparator circuit used to correlate the output of the photosensor. A main controller 50 conventionally includes a CPU, a ROM for storing complete programs and a RAM. Controller 50 controls the movement of carriage 12 as well as other printer functions described below.

When a line recording operation is performed, each resistor associated with a jet in printhead 18 is driven selectively in accordance with image data from a personal computer P/C 52 or other data source sent into controller 50. Controller 50 sends drive signals to the printhead 18 heater resistors causing ink droplets to be ejected from the jets associated with the heated resistor thus forming a line of recording on the surface of the recording medium 24.

For purposes of description, the sensing system will be considered as being activated at the beginning of a print job.

Operation at Start of Print Job

Referring to FIGS. 1–4, image signals from the P/C 52 to controller 50 initiate a start print sequence. Carriage 12 is moved to sensing station 41 so as to position housing wall 17A of container 16 adjacent and facing the optical assembly 30. Under control of controller 50, a power source 56 energizes light source 36. Source 36, in a preferred embodiment, is an LED with a peak wavelength in the range of 880 to 940 nm. A beam of light is directed towards housing wall 17A. Light is reflected from reflective surfaces 22D, 22E of roof mirror 22 and redirected so as to impinge on photosensor 38. The two reflections allow the beam to be stepped vertically downward to avoid a higher than acceptable angle of incidence at the detector. The output signal from photosensor 38 is sent to logic circuitry within controller 50.

As a first example, assume cartridge 10 is Cartridge A type having the polished aluminized tape 22D, 22E of a first reflective level. The light impinging on photosensor 38 results in an output current of, about 2700 $\mu$a to flow. An output signal, $V_{out}$, is sent to printhead cartridge identification circuit 60 in controller 50. Assuming a $V_{out}$ of 3.0–5.0V, this circuit compares the photosensor output signal to signal levels stored in memory and finds a "match" confirming the presence of Cartridge A. Appropriate signals are sent to printhead drive circuit 61 as well as other appropriate timing circuits to cause the ensuing print function to accommodate the specific characteristics of the identified printhead Cartridge A.

As a second example, assume cartridge 10 is Cartridge B type having the polished aluminized tapes 22D, 22E of a second, lower, reflective level. The intensity of the reflected light impinging on photosensor 38 results in an output current of about 240 $\mu$a. Circuit 60 compares the $V_{out}$ (assume a $V_{out}$ of 0.6–3.0 volts) to signal levels stored in memory and finds a "match" confirming the presence of Cartridge B and prepares the printer for operation with a Printhead Cartridge B characteristic.

If the printer cannot identify the photosensor 38 signals as being either from Cartridge A or Cartridge B, further printing may be disabled and a warning sent to the user (at P/C Display 55) indicating the cartridge type is not compatible with the printer. It is understood that the term "cartridge" can indicate either the ink container or the printhead, or the combination of ink tank and printhead. Thus, it is possible that either the wrong ink container or the wrong printhead cartridge assembly has been identified as not compatible.

From the above two examples, it will be apparent that by simply changing the reflective material, any reflective intensity desired could be selected and the number of different types of printhead cartridges capable of being identified could be expanded accordingly. However, in order to maintain sufficient discrimination between intensity levels, it is believed that approximately three levels of intensity (e.g., three effective type of materials) may be optimum.

Figure 5:
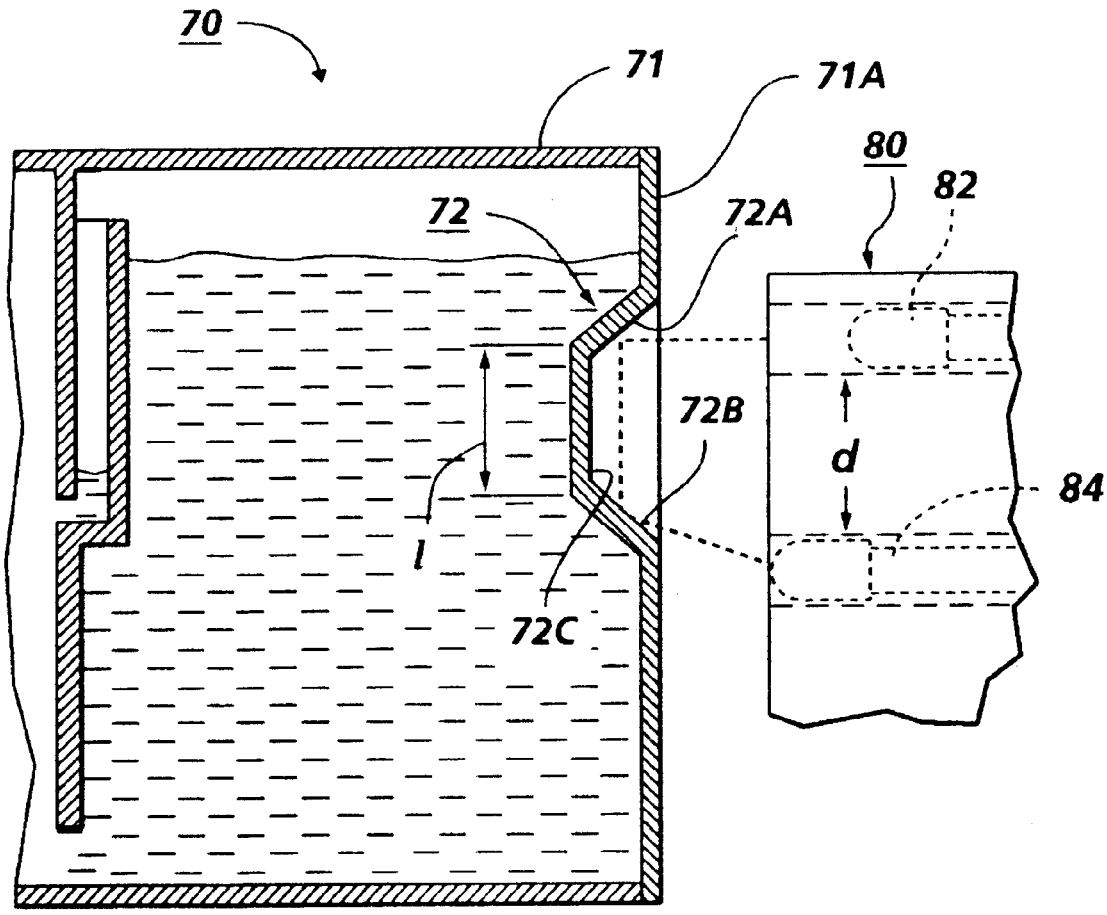
FIG. 5 shows a cross-sectional view of a printhead cartridge of a first type aligned with a cartridge sensing assembly which provides a positive ID for that cartridge.
Figure 6:
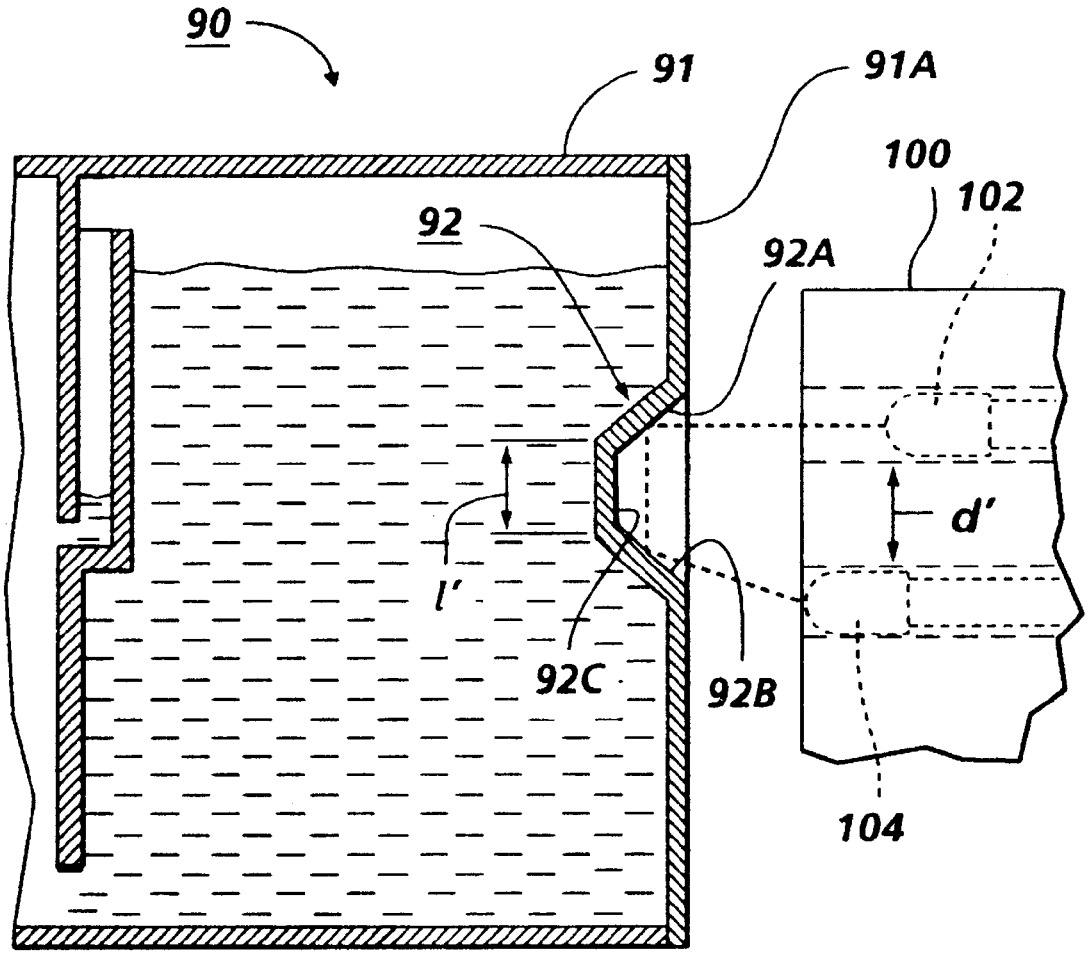
FIG. 6 shows a cross-sectional view of a printhead cartridge of a second type aligned with a cartridge sensing assembly which provides a positive ID for this cartridge.

According to a second aspect of the invention, the printhead cartridge type can be identified by correlating the location of the light source 36 and light detector 38 in optical assembly 30 with the location of the reflector 22 in the ink container. FIGS. 5 and 6 show two cartridge ID sensing configurations which confirm a "correct" cartridge while, to demonstrate the principle, FIG. 6 shows the cartridge of FIG. 5 being "read" by the optical assembly of FIG. 5 resulting in identification of that cartridge as an "incorrect" cartridge.

Referring to FIG. 5, a printhead cartridge 70 has an ink container 71 with light directing element 72 formed as part of wall 71A. Light detecting element 72 is a roof mirror having two facet surfaces 72A, 72B connected by surface 72C having a length l. Surfaces 72A, 72B are made reflective by any known technique including one of the two previously described reflective tapes. Optical assembly 80 contains a light source 82 and a photosensor 84 separated vertically by a distance d. Distance d is approximately equal to the length l of surface 72C. Assembly 80 is mounted in the path of the scanning carriage so that container 71 can be moved into position opposite the assembly 30. When light source 82 is energized, light is reflected from surface 72A to surface 72B to impinge on photosensor 84. A "high" output signal is sent from photosensor 84 to the cartridge identification circuit 60 in FIG. 3 which identifies the cartridge as, say a Cartridge Type C. The printer then prepares for a printing operation based on the characteristics of the Type C cartridge.

Referring to FIG. 6, a printhead cartridge 90 has an ink container 91 with light directing element 92 formed as part of wall 91A. Light detecting element 92 is a roof mirror having two facet surfaces 92A, 92B connected by surface 92C having a length 1'. Surfaces 92A, 92B are made reflective by any known technique including one of the two previously described reflective tapes. It is noted that element 92 is at a lower position in wall 91A than the position of element 72 in FIG. 5 because of the shorter length of the surface between the two reflecting sensors; e.g., 1' is shorter than 1'. Optical assembly 100 contains a light source 102 and a photosensor 104 separated by a distance d' shorter than the distance d for the FIG. 5 embodiment. Distance d' is approximately equal to the 1' length of surface 92C. Assembly 100 is mounted in the path of the scanning carriage so that container 91 can be moved into position opposite the assembly 100. When light source 102 is energized, light is reflected from surface 92A to surface 92B to impinge on photosensor 104. A "high" output signal is sent from photosensor 104 to the cartridge identification circuit 60 in FIG. 3 which identifies the cartridge as, say Cartridge Type D. The printer then prepares for a printing operation based on the characteristics of the Type D cartridge.

Figure 7:
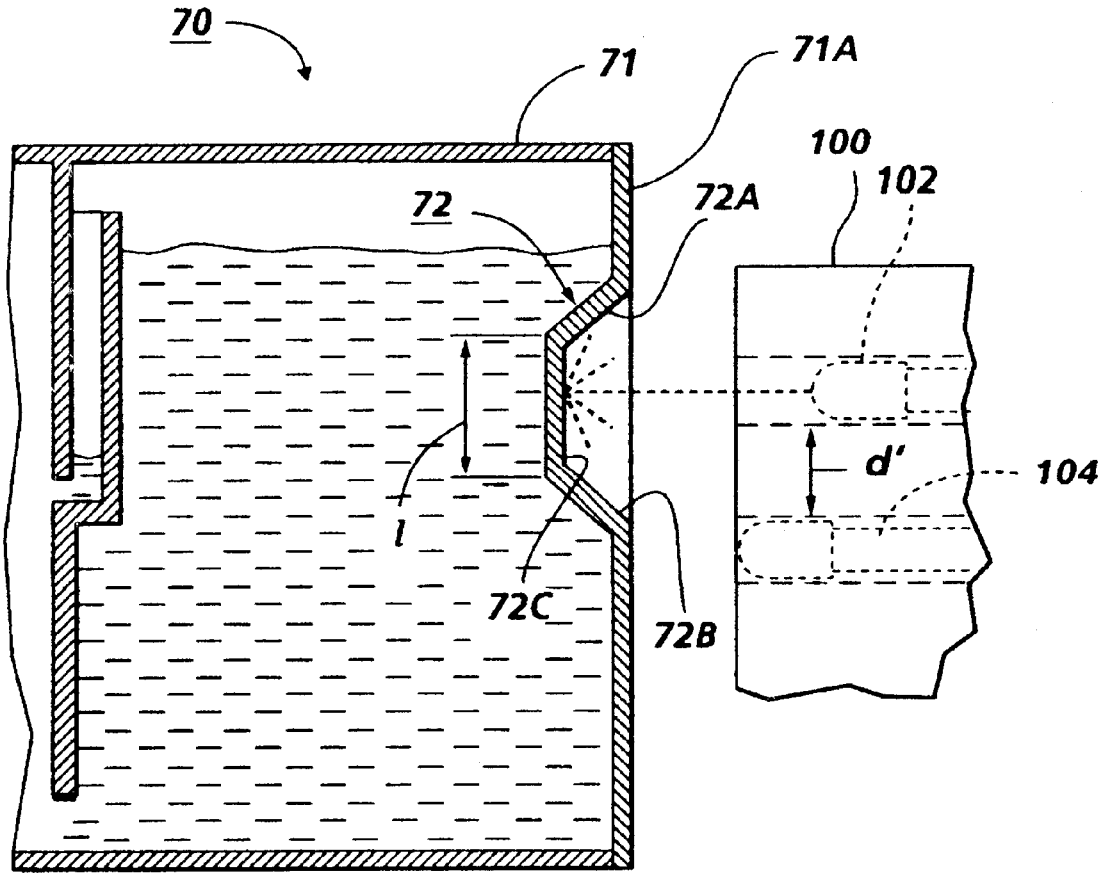
FIG. 7 shows the cartridge of FIG. 4 aligned with the cartridge sensing assembly of FIG. 5 to demonstrate a negative ID.

Referring next to FIG. 7, this shows cartridge 70 (Type C) inserted in the carriage and brought opposite optical assembly 100 which is configured to detect a Type D cartridge. When the light source 102 is energized, the light impinges on surface 72C causing the light to scatter. Thus, almost no light reaches photosensor 104, and the output is a "low" level signal which is recognized by circuit 60 as a "wrong cartridge" signal. (Circuit 60 has been waiting for a "high" signal indicating a Type C cartridge.) It is apparent that the same result will occur if optical assembly 80 (Type C) attempts to identify cartridge 90 (Type D); e.g., pulsing of light source 82 will result in a signal directed above the light directing element 92 resulting in no output signal from detector 84. For the first case, the distance d' is not approximately equal to 1'; for the second case d will not be approximately equal to 1'.

Figure 8A:
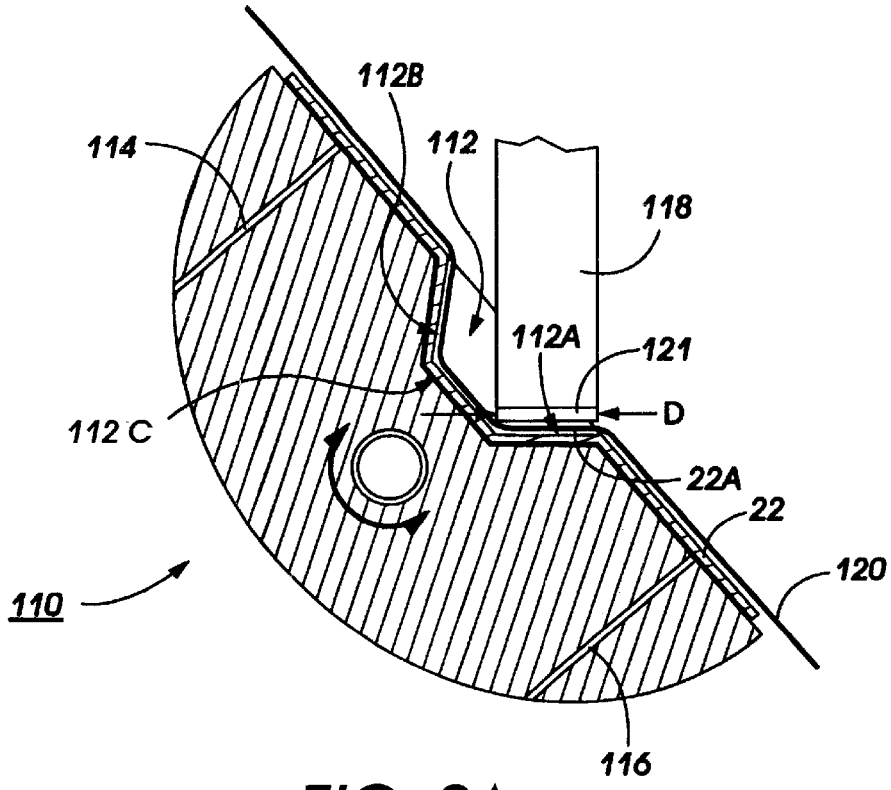
FIGS. 8A and 8B show a test fixture for forming light reflecting surfaces built into the printhead cartridge.
Figure 8B:
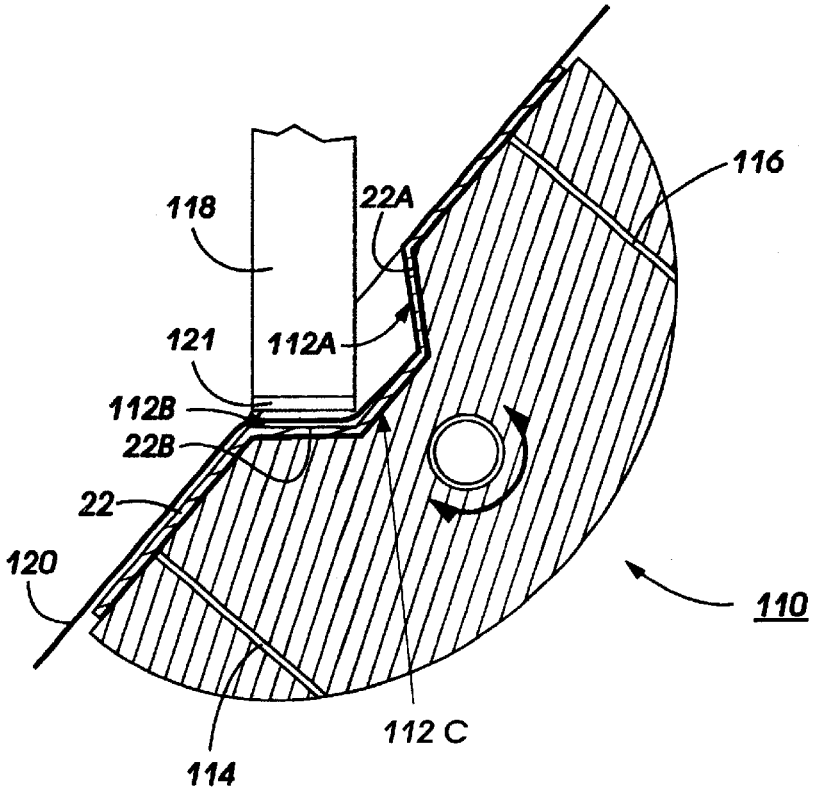

A preferred hot stamping method for attaching the reflective tapes 22D, 22E shown in FIGS. 1 and 3 embodiment will now be described with additional reference to FIGS. 8A, 8B. In FIG. 8A, reflective element 22 is shown seated in a specially designed supporting member 110. Member 110 has a semi-cylindrical shape with a cavity 112 having surfaces 112A, 112B, 112C formed so as to conform to the surfaces 22A, 22B, 22C, respectively. Element 22 is held in a seated position by a vacuum (not shown) applied to vents 114, 116. Member 110 is pivoted to the position shown in FIG. 8A so as to bring surface 112A to a horizontal position. A strip 120 of reflective tape is placed across the top of the cavity 112. Hot stamping tool 118, in one embodiment, has a flat silicone rubber bonding surface 121 having a width D approximately equal to the width of surfaces 22A, 22B. The tool is lowered into contact with tape 120 and forces a portion of the tape into heated compressive contact with surface 112A bonding that portion of the tape (tape 22A) to surface 112A. The tool is withdrawn and member 110 pivoted to the position shown in FIG. 8B where surface 112B is now brought to a horizontal orientation. Tape 22B is formed in the same manner as tape 22A. The ends of tape strip 120 is then cut, and element 22 is ready for mounting into container wall 17A.

The hot stamping method is preferred over prior art techniques such as using a relatively expensive pressure sensitive tape or wherein reflective layers are vacuum deposited on the reflector surfaces. The use of a hot stamp tool whose bonding end has a surface orientation which conforms to the sloping surface of the cavity to which the tape is to be bonded is therefore preferred. Prior art hot stamp methods created shearing forces when the tool was removed resulting in a tool life less than 1,000 cycles. Print quality was also adversely affected by creating wrinkles and folds in the stamped material. The hot stamp method of the present invention, using compression forces, improves tool life to at least 20,000 cycles with improved print quality and enables the stamping process to become fully automated.

It is understood that these techniques have utility for bonding a variety of materials to cavity sloping walls. It will be appreciated that the cavity may have more than two sloping surfaces with the nesting fixture undergoing a plurality of incremental pivoting movements to accommodate the number of sloped surfaces to which the tape is to be bonded.

Figure 9:
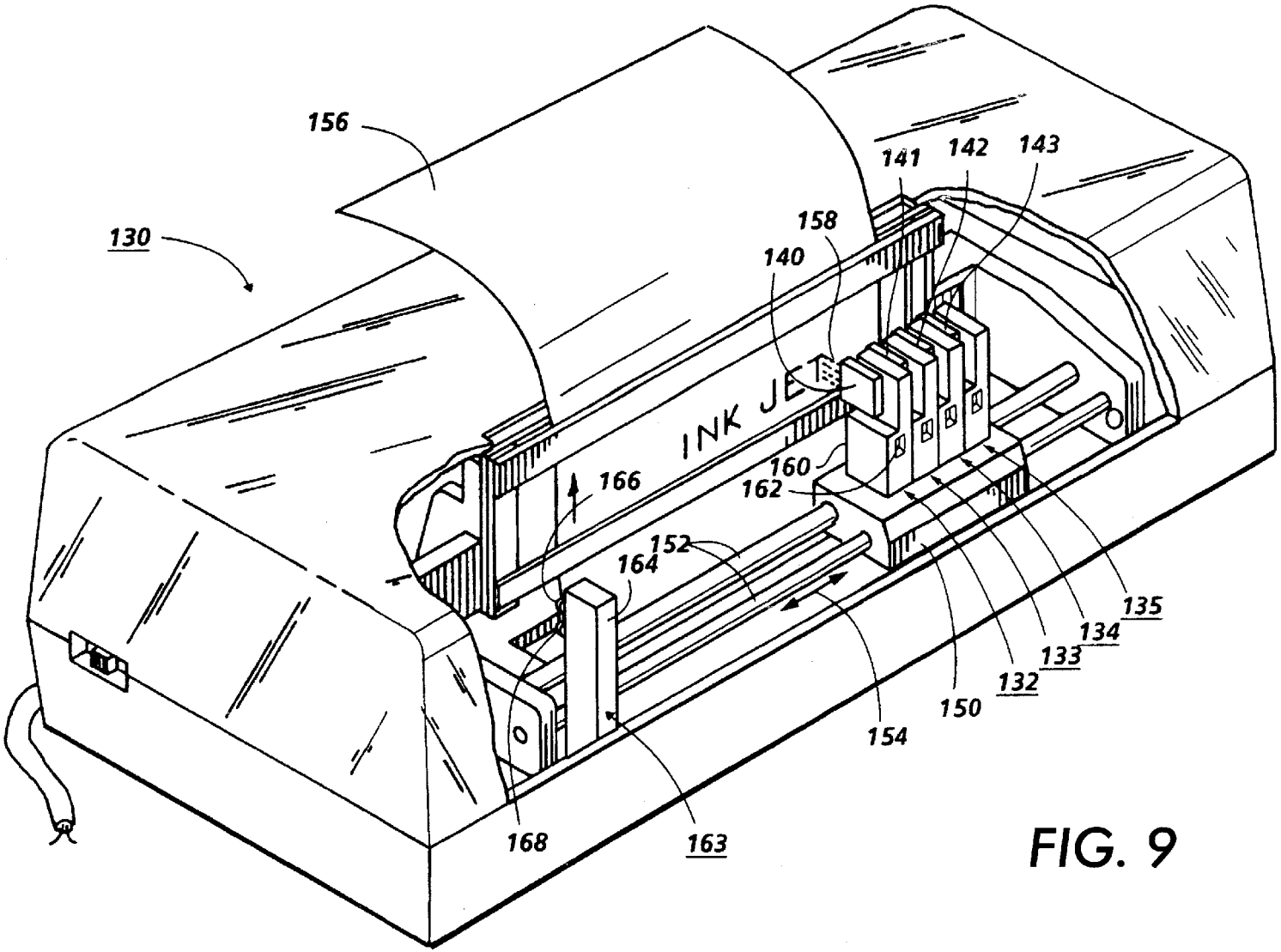
FIG. 9 illustrates a perspective view of a color ink jet printer which incorporates the printhead cartridge identification system of the present invention.

While the cartridge ID system has been disclosed in the context of identifying a single cartridge, the invention can be used to identify a plurality of cartridges; e.g., multiple cartridges used in a color printer. FIG. 9 shows a full color scanning type of printer. Referring to FIG. 8, a thermal ink jet printer 130 is shown. Several ink supply cartridges 132, 133, 134, 135, each with an integrally attached thermal printhead 140 to 143, are mounted on a translatable carriage 150. During the printing mode, the carriage 150 reciprocates back and forth on guide rails 152 in the direction of arrow 154. A recording medium 156, such as, for example, paper, is held stationary while the carriage is moving in one direction and, prior to the carriage moving in a reverse direction, the the recording medium is stepped a distance equal to the height of the stripe of data printed on the recording medium by the thermal printheads. Each printhead has a linear array of nozzles which are aligned in a direction perpendicular to the reciprocating direction of the carriage. The thermal printheads propel the ink droplets 158 toward the recordings medium 156 whenever droplets are required, during the traverse of the carriage, to print information. The signal-carrying ribbon cables attached to terminals of the printheads have been omitted for clarity. The printer 130 can print in multiple colors, wherein each cartridge 132 to 135 contains a different color ink supply. For a representative color printer and additional control details, see for example, U.S. Pat. No. 4,833,491, the disclosure of which is incorporated herein by reference.

According to the invention, each of the ink containers forming part of cartridges 132–135 are of the same construction as the cartridge shown in FIGS. 1, 3; e.g., each cartridge has an ink container having a prism reflector formed in the wall facing outward. The reflector is associated with cartridge ID detection. Cartridge 132 is shown having an ink container 160 with reflective member 162. Cartridges 133–135 have similar containers and reflective members not specifically called out for ease of description. As in the single cartridge embodiment, a sensing assembly 163 includes a housing 164 within which are mounted a light source 166 and a photosensor 168.

In operation and referring to FIGS. 3 and 9, image signals from P/C 52 to controller 50 initiate a start print sequence. Carriage 150 is moved so as to position the cartridge 132 with first ink container 160 opposite the sensing assembly 162. Under control of controller 50, power source 54 is caused to sequentially energize light source 166 while measuring the output of photosensor 168. The sequencing and detection operation for cartridge 132 is the same as that previously described for cartridge 10. Source 166 is first energized to check that the cartridge is the correct type (reflections from member 162 reach the photosensor to provide an output within a predicted range). Once cartridge 132 ID is confirmed, carriage 150 is moved to position the next cartridge 133 in position to be sensed. The preceding process is enabled for each cartridge until all cartridges have been identified as being in the "correct" cartridge. Printing operations can then be instituted. After some period of operating time, one or more cartridges may become depleted of ink and have to be replaced. The cartridge ID sensing is repeated to insure that the replacement cartridge is of the required type for the specific printing system. It is noted that, for these and earlier embodiments, if a cartridge is inserted so it is not fully seated in its operative position (e.g., tilted upward), an incorrect reading will alert the operator to check the cartridge and, if the cartridge is skewed, proper seating can be implemented.

While the embodiment disclosed herein is preferred, it will be appreciated from this teaching that various alternative, modifications, variations or improvements therein may be made by those skilled in the art. For example, while the optical sensing assembly 30 has been shown in a fixed position with carriage 12 moved so as to present the ink cartridges in adjacency, the sensing assembly could be moved past stationary cartridges. Also, for the color configuration of FIG. 9, instead of the carriage being incrementally moved past the fixed optical assembly, four optical assemblies could be used with the carriage moved so as to align each cartridge with a separate sensing assembly and sequence the cartridges. As a further example, other materials could be used instead of the ones described for tapes 22D, 22E; including reflective metals, mirrors, pressure sensitive tapes, etc.

In another embodiment, light source 36 can emit light in wavelengths other than in the range of 880–940 nm.

What is claimed is:

1. A thermal ink jet printing system which includes, in combination, at least a first and second cartridge, each cartridge of a type having different color printing characteristics, each cartridge including:

a printhead for printing a color associated with at least said first or second cartridge type onto a recording medium, an associated ink supply container for providing ink of said color to said printhead, said container having at least a wall with a reflective surface having a reflective intensity associated with at least said first or second cartridge type, means for moving said cartridge along a printer scan path, an optical sensing station located along said scan path and comprising a light source and a photosensor, means for moving said cartridge into said sensing station so that said reflective surface is opposite said light source output, means for energizing said light source, said photosensor sensing a light source output beam reflected from said reflective surface and having a reflective intensity which varies depending upon the cartridge type and generating an output signal representative of the incident light intensity and means for analyzing said photosensor output signal to correlate said signal with a predetermined signal corresponding to at least said first and second cartridge type and to confirm the cartridge type if said correlation is found.

2. The system of claim 1 and wherein each print cartridge is positioned, by said cartridge moving means, opposite the optical sensing station and subjected to the same identification step.

3. A method for bonding a reflective tape to the sloping recessed surface of a cavity formed in a pivotable semi-cylindrical supporting member, comprising the steps of:

(a) seating the cavity of the integrated member into a similarly formed cavity formed in the surface of the supporting member, (b) pivoting the supporting member so that a sloping surface to which tape is to be bonded is in a horizontal plane, (c) bringing a hot stamping tool with a flat heated bonding surface into contact with a tape, (d) pressing the tape into heated contact with the horizontally aligned recessed surface until the tape is bonded thereto, (e) pivoting the supporting member so that the next sloping surface to which tape is to be bonded is in a horizontal plane and (f) repeating steps (b), (c), and (d) until tape has been bonded to all desired sloping surfaces.

4. The method of claim 3 in which the flat heated bonding surface of the hot stamping tool comprises silicone rubber.

5. A method for identifying at least a first or second type of printhead cartridge, each cartridge type comprising a printhead and an ink container, mounted on a movable carriage and used in an ink jet printer including the steps of:

directing a beam of light into an optical sensing station, moving said carriage into said optical sensing station so that a reflective surface of said ink container intercepts said light beam, the reflective surface having a reflective intensity associated with said at least first or second cartridge type, the reflective intensity varying with said cartridge type, sensing the intensity of the light redirected back from said reflective portion, generating a signal representative of the intensity of the sensed reflected light, analyzing the signal to determine whether the signal conforms to a predetermined signal level associated with said cartridge type and disabling further operation of said ink jet printer if the signal does not conform to said predetermined signal level.

6. An ink jet printhead cartridge sensing system for identifying a specific type of cartridge, the sensing system comprising at least one printhead cartridge comprising a printhead fluidly connected to an ink container:

an optical assembly including a light source and a photosensor separated from each other by a set distance, means for positioning said cartridge adjacent said optical assembly, said ink container including at least one light reflective member comprising at least a first and second reflective member connected by a third surface, meaning for energizing said light source when said cartridge is adjacent said optical assembly, the light source emitting a beam of light which is directed generally towards said reflective member and reflected therefrom towards said photosensor, said photosensor generating a high output signal when the separation distance between the light source and the photosensor is approximately equal to the length of the third surface connecting the first and second reflective surfaces and a low output signal when the separation distance and the third surface length are not approximately equal, and cartridge identification means for processing the photosensor output signal and determining whether the signal corresponds to a predetermined signal representative of a specific type of cartridge.

7. The sensing system of claim 6 wherein said light reflective member is a roof mirror.

8. A system for identifying a printhead cartridge, the system including a printhead cartridge comprising a printhead fluidly connected to an ink container incorporating a reflective element having a first and second reflective surface separated by a predetermined spacing, the system further including, a sensor assembly including a light directing means and an optical sensor separated by a predetermined spacing, means for positioning the sensor assembly in the position to direct light towards said reflective element wherein light is reflected from said first surface to said second surface and onto the photosensor generating an output signal whereby the predetermined spacing separating the first and second reflective surfaces is approximately equal to the predetermined spacing separating the light directing means in the optical sensor and means for analyzing the photosensor output signal and identifying whether a particular printhead cartridge has said approximately equal predetermined spacing.

9. In a thermal ink jet printer for printing images on a recording medium using a plurality of different types of cartridges, each cartridge type having individual printing characteristics, a cartridge type identification system comprising:

a reflective element forming part of said cartridge, said reflective element having a reflective intensity associated with an individual cartridge type, the reflective intensity level differing by cartridge type, an optical assembly including a light source and a photosensor, means for positioning said reflective element so that light from said light source is incident on said reflective member surface and reflected therefrom, said photosensor detecting the amount of light reflected from said reflective member and generating an output signal and cartridge type identification means for processing the photosensor output signal to determine the cartridge type.

10. The printer of claim 9 wherein said reflective element comprises a reflective material with a reflective surface having a reflective intensity which varies by cartridge type.

11. The printer of claim 10 wherein said reflective material is a reflective tape heat bonded to said reflective element.

12. The printer of claim 9 wherein said reflective element comprises at least a first and second reflective surface, said incident light being directed from said first reflective surface to said second reflective surface to said photosensor.

13. The printer of claim 9 wherein said reflective element is formed on an ink container forming part of said cartridge.

14. A sensing system for an ink jet printer including:

a first print cartridge having a first reflective element formed thereon, said reflective element having a first reflective intensity, at least a second print cartridge having a second reflective element formed thereon, said second reflective element having a second reflective intensity different from said first reflective intensity, a light source periodically pulsed to direct a light beam towards either said first or second reflective element, a photosensor for detecting light reflected from said first or second reflective elements and for generating an output signal indicative of the intensity of sensed light and means for analyzing the output signal and for determining whether the output signal is within a signal level range associated with said at least first or second print cartridge.

15. The sensing system of claim 14 wherein the first and second light reflective elements each comprise at least a first and second reflective surface, said light beam being reflected from said first surface to said second surface to said photosensor.

16. The sensing system of claim 15 wherein said first and second reflective surfaces reflecting said light beam at a reflective intensity to provide a corresponding photosensor output signal associated with one of said at least first or second print cartridges.

17. A sensing system of claim 15 wherein said first and second reflective surfaces reflect said light beams at a second intensity to produce a corresponding photosensor output signal associated with a second cartridge type.

* * * * *